US010424132B2

(12) United States Patent
Chen et al.

(10) Patent No.: US 10,424,132 B2
(45) Date of Patent: Sep. 24, 2019

(54) VEHICLE COMPONENT FAILURE PREVENTION

(71) Applicant: HITACHI, LTD., Tokyo (JP)

(72) Inventors: Heming Chen, Farmington Hills, MI (US); Nikhil Seera, Farmington Hills, MI (US); Yuan Xiao, Farmington Hills, MI (US); Sujit S. Phatak, Farmington Hills, MI (US)

(73) Assignee: Hitachi, Ltd., Tokyo (JP)

( * ) Notice: Subject to any disclaimer, the term of this patent is extended or adjusted under 35 U.S.C. 154(b) by 206 days.

(21) Appl. No.: 15/429,257

(22) Filed: Feb. 10, 2017

(65) Prior Publication Data

US 2018/0232964 A1 Aug. 16, 2018

(51) Int. Cl.
*G07C 5/08* (2006.01)
*G07C 5/00* (2006.01)

(52) U.S. Cl.
CPC ..... *G07C 5/0808* (2013.01); *G07C 5/008* (2013.01)

(58) Field of Classification Search
CPC ..... G07C 5/0808; G07C 5/008
USPC ..... 701/31.4
See application file for complete search history.

(56) References Cited

U.S. PATENT DOCUMENTS 9,286,735 B1 * 3/2016 Ahn ..... G06N 7/005
9,721,400 B1 * 8/2017 Oakes, III ..... G07C 5/0808
2009/0019834 A1 * 1/2009 Aoki ..... F01N 3/0807 60/277
2009/0118897 A1 * 5/2009 Schoeggl ..... G07C 5/006 701/31.4
2010/0250149 A1 * 9/2010 Omori ..... G01R 31/2849 702/34
2011/0178724 A1 * 7/2011 Uluyol ..... G01M 13/04 702/34
2016/0035155 A1 2/2016 Rice et al.
2016/0093119 A1 * 3/2016 Ahn ..... G07C 5/006 701/29.3
2016/0129954 A1 * 5/2016 Hasselbusch ..... B62D 55/20 305/15

(Continued)

FOREIGN PATENT DOCUMENTS

EP 2 056 179 A2 5/2009
WO 2011/114419 A1 9/2011

OTHER PUBLICATIONS

Extended European Search Report received in corresponding European Application No. 18152696.3 dated Jul. 3, 2018.

(Continued)

*Primary Examiner* — Krishnan Ramesh
(74) *Attorney, Agent, or Firm* — Mattingly & Malur, PC

(57) ABSTRACT

In some examples, a system may receive, over a network from a vehicle computing device onboard a vehicle, sensor data for at least one sensed parameter of a vehicle component. The system may determine, based on the sensor data, a damage result indicative of fatigue damage to the vehicle component. Based at least partially on the damage result, the system may send a communication to at least one of the vehicle computing device onboard the vehicle, or a computing device associated with an account associated with the vehicle. In some cases, the damage result may be determined from at least one of accessing a lookup table using the sensor data, or executing a fatigue simulation using sensor data.

20 Claims, 11 Drawing Sheets

(56) References Cited

U.S. PATENT DOCUMENTS

| | | | | |
|---|---|---|---|---|
| 2016/0187432 | A1* | 6/2016 | Saint-Marcoux | B60L 58/12<br>702/63 |
| 2017/0221069 | A1* | 8/2017 | Remboski | G07C 5/0825 |
| 2018/0141565 | A1* | 5/2018 | Petrak | B60W 50/0205 |

OTHER PUBLICATIONS

Japanese Office Action received in corresponding Japanese Application No. 2018-011395 dated Sep. 25, 2018.

* cited by examiner

500

| 502 | 504 | 506 | 508 |
|---|---|---|---|
| TIME (S) | LOAD X (N) | LOAD Y (N) | LENGTH L (MM) |
| 0 | 509.06 | -2479.1 | 396.9964 |
| 0.002 | 516.68 | -2390.4 | 397.1076 |
| 0.004 | 539.09 | -2558.3 | 396.9266 |
| 0.006 | 520.94 | -2427.0 | 396.8865 |
| 0.008 | 520.23 | -2350.9 | 397.0366 |
| 0.01 | 539.27 | -2504.6 | 396.8872 |
| 0.012 | 538.83 | -2465.2 | 397.0363 |
| 0.014 | 513.99 | -2437.5 | 397.0252 |
| ⋮ | ⋮ | ⋮ | ⋮ |

FIG. 5

800

| 802 | 804 | 806 | 808 |
|---|---|---|---|
| LOAD X AMPLITUDE (N) | LOAD Y AMPLITUDE (N) | LENGTH L (MM) | DAMAGE |
| 300 | 1000 | 300 | 9.01e-8 |
| 400 | 1500 | 325 | 1.72e-7 |
| 500 | 2000 | 350 | 2.23e-7 |
| 600 | 2500 | 375 | 4.39e-7 |
| 700 | 3000 | 400 | 5.02e-7 |
| ⋮ | ⋮ | ⋮ | ⋮ |

FIG. 8

1000

| 802 | 804 | 806 | 808 |
|---|---|---|---|
| LOAD X AMPLITUDE (N) | LOAD Y AMPLITUDE (N) | LENGTH L (mm) | DAMAGE |
| 300 | 900 | 300 | 8.12e-8 |

FIG. 10

VEHICLE COMPONENT FAILURE PREVENTION

BACKGROUND

Motor vehicles have become complex machines that contain a variety of mechanical, electrical, and embedded computer systems. Routine service is critical to ensure the safe and efficient operation of a vehicle. For example, customers who own a fleet of vehicles may spend a substantial part of the overall cost of operation on vehicle maintenance.

Traditional vehicle maintenance is preventive and designed to reduce the likelihood of service interruption. For instance, a vehicle owner typically follows the vehicle manufacturer's recommended maintenance schedule. However, the manufacturer's maintenance schedule often recommends a predetermined and conservative schedule based on the manufacture's own estimates for normal vehicle usage without being able to account for the actual operational conditions of individual vehicles. As a result, vehicle parts often experience early retirement for vehicles operated in mild environments simply because the replacement of these parts is recommended by the maintenance schedule. On the other hand, vehicles operated in harsh environments may sometimes fail between two scheduled services because the maintenance schedule is not able to account for the particular driving conditions experienced by the individual vehicles.

SUMMARY

Some implementations include arrangements and techniques for preventing failure of a vehicle component. For example, a system may receive, over a network from a vehicle computing device onboard a vehicle, sensor data for at least one sensed parameter of the vehicle component. The system may determine, based on the sensor data, a damage result indicative of fatigue damage to the vehicle component. Based at least partially on the damage result, the system may send a communication to at least one of the vehicle computing device onboard the vehicle, or a computing device associated with an account associated with the vehicle. In some cases, the damage result may be determined from at least one of accessing a lookup table using the sensor data, or executing a fatigue simulation using sensor data.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features.

FIG. 5 illustrates an example data structure of received sensor data according to some implementations.

FIG. 8 illustrates an example data structure of sensor data and corresponding damage results according to some implementations.

FIG. 10 illustrates an example data structure including results from the fatigue simulation according to some implementations.

DETAILED DESCRIPTION

Figure 1:
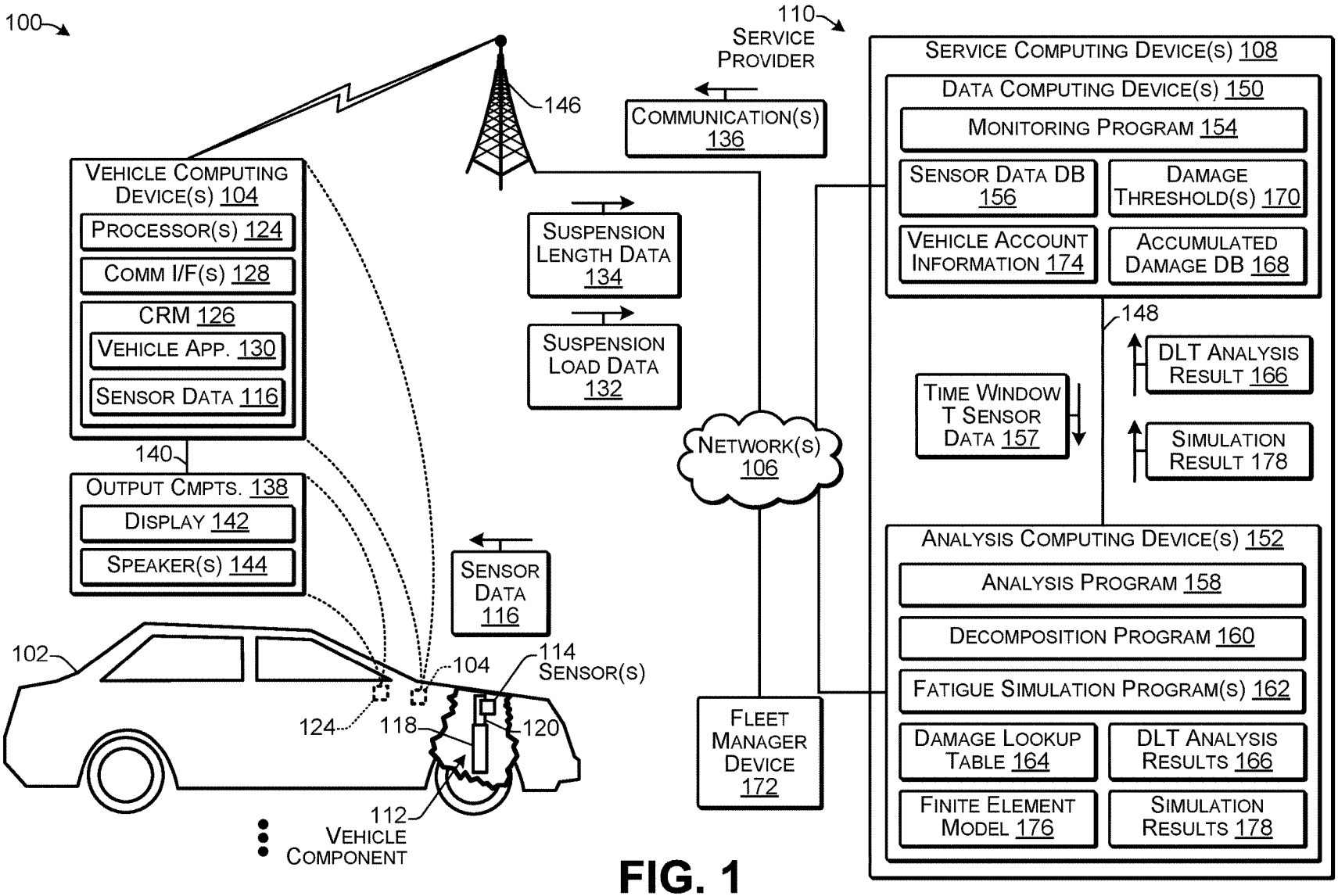
FIG. 1 illustrates an example system for preventing failure of vehicle components according to some implementations.

The technology herein includes novel arrangements and techniques for preventing failure of vehicle components. Implementations herein provide an improvement in the operation of a vehicle by determining when a vehicle component has failed, is likely to fail, or otherwise has been damaged, and may cause a warning to be presented to a vehicle operator to prevent breakdown, crashing, or other failures of the vehicle. In addition, such as in the case of monitoring a fleet of vehicles, when a threshold level of damage to a vehicle component of a particular vehicle in the fleet has been detected, the system may send a communication to the fleet manager to indicate that maintenance is to be performed.

As one example, a system may determine a precise amount of fatigue damage incurred by a vehicle component, such as a suspension component, an engine component, transmission component, a fuel system component, a chassis component, or the like, that may be subject to fatigue failure. When the system determines that a threshold amount of damage has occurred to the vehicle component, the system may send a communication to the vehicle to cause the vehicle to warn the vehicle operator of the detected damage. For example, a visible and or audible warning may be presented in the vehicle, such as a warning light, a visible message, or an audible warning. Additionally, or alternatively, such as in the case of a fleet of vehicles, the system may send a communication to a manager of the fleet, or to other interested parties, to provide a notification that the vehicle component has been damaged, such as to provide a warning that the vehicle component is ready to be replaced. Accordingly, implementations herein may be used by fleet owners, automotive component suppliers, original equipment manufacturers, consumers, and so forth.

One or more sensors on the vehicle may measure one or more parameters of the vehicle component as the vehicle is operated. The measured parameters may be parameters that are indicative of an expected cause of failure of the vehicle component. The measured parameters may be stored as sensor data and may be sent from the vehicle over a network to a service computing device. In some cases, the system may execute a computer simulation using the sensor data received from an individual vehicle to determine the amount of fatigue damage experienced by the actual vehicle component of the vehicle. Thus, the simulation may determine the likely fatigue damage experienced by the vehicle component. As one example, a computational model, such as a finite element model of the vehicle component may be generated using manufacturing knowledge about the vehicle component (e.g., geometry, connections, materials, predicted loads, etc.) without using any historical data about the vehicle. A fatigue simulation may then be executed for the vehicle component using the sensor data received from the sensor(s) for determining fatigue damage to the vehicle component. Accordingly, implementations herein enable predictive and preventive maintenance of automotive components without requiring that a large quantity of historical data be obtained in advance.

In addition, the computational model may be reused for different vehicles that incorporate the same type of vehicle component, e.g., even if these different vehicles are owned by different fleets and/or operated by different operators. For example, the same vehicle component may often be used in different models and different brands of vehicles. Further, the computational model may be constructed only based on knowledge of the vehicle component and does not require any knowledge about the vehicle, driver, geographic location, etc. Consequently, the same computational model may be used for the same vehicle component even if the vehicle component is installed in a different type of vehicle driven by different drivers under different driving conditions. Since the computational model may be a model of the component itself, the computational model can be easily transferred between different vehicle environments to enable the implementations herein to be applied to new or different vehicles. Thus, the lead-time to deploy implementations herein may be shorter than for conventional techniques. For example, conventional techniques might require historical data, such as test data, from each different vehicle manufacturer or component manufacturer, etc., which may be time consuming and expensive to obtain.

For discussion purposes, some example implementations are described in the environment of a vehicle that sends sensor data about a vehicle component to one or more service computing devices that determine any damage to the component based on the sensor data. However, implementations herein are not limited to the particular examples provided, and may be extended to other service environments, other vehicle components, other system architectures, other vehicle computing device arrangements, other sensor configurations, and so forth, as will be apparent to those of skill in the art in light of the disclosure herein.

FIG. 1 illustrates an example system 100 able to prevent failure of vehicle components according to some implementations. The system 100 includes one or more vehicles 102 that may each include a vehicle computing device 104 able to communicate over one or more networks 106 with one or more service computing devices 108 of a service provider 110. The vehicle 102 includes at least one vehicle component 112 that may be monitored for damage. One or more sensors 114 are associated with the vehicle component 112 and may provide sensor data 116 to the vehicle computing device 104.

In this example, the vehicle component 112 is a suspension component, such as a strut, shock absorber, or the like, and may include a body 118 and an extensible rod 120 that moves in and out of the body 118. However, implementations herein are not limited to any particular type of vehicle component 112. For example, the techniques herein may be applied to any vehicle component that is subject to fatigue failure including other types of suspension components, transmission components, such as a transmission shaft, differential components, engine components, such as a fuel rail, chassis components, and so forth.

In this example, the sensors 114 may include one or more strain gauges as sensors 114 that may measure forces on the rod 120, such as in an X direction and a Y direction, which may both be generally perpendicular to a direction of travel of the rod 120 in and out of the body 118 (i.e., a Z direction). In addition, the sensors 114 may include a length sensor that measures a length L of how far the rod 120 extends beyond the body 118. As one example, the length sensor may be a linear variable differential transformer (LVDT). An LVDT is a type of electrical transformer used for measuring linear displacement. The farther that the rod 120 extends from the body 118 of the component (i.e., the greater the length L), then the greater the likelihood that the rod 120 may be bent by any X or Y forces. Furthermore, while a single vehicle 102 and single vehicle component 112 are shown for clarity in this example, in use, there may be a large number of vehicles of various different types, each having sensors 114 included for a variety of different vehicle components 112 on each vehicle 102, examples of which are enumerated above.

The vehicle computing device 104 may include at least one processor 124 and one or more computer readable media (CRM) 126. In addition, the vehicle computing device 104 may include one or more communication interfaces 128. The processor 124 may be implemented as one or more microprocessors, microcomputers, microcontrollers, digital signal processors, central processing units, state machines, logic circuitries, and/or any devices that manipulate signals based on operational instructions. In some cases, the processor 124 may be one or more hardware processors and/or logic circuits of any suitable type specifically programmed or configured to execute the algorithms and processes described herein. The processor 124 may be configured to fetch and execute computer-readable, processor-executable instructions stored in the computer-readable media 126. As one non-limiting example, the processor 124 may include one or more vehicle ECUs or other embedded systems that are connected to the communication interface(s) 128 via a Controller Area Network (CAN bus).

The one or more computer-readable media 126 may be an example of tangible non-transitory computer storage media and may include volatile and nonvolatile memory and/or removable and non-removable media implemented in any type of technology for storage of information such as computer-readable processor-executable instructions, data structures, program modules, or other data. The computer-readable media 126 may include, but is not limited to, RAM, ROM, EEPROM, flash memory, solid-state storage, magnetic disk storage, optical storage, and/or other computer-readable media technology. Accordingly, the computer-readable media 126 may be computer storage media able to store instructions, modules, or applications that may be executed by the processor 124. Further, when mentioned, non-transitory computer-readable media exclude media such as energy, carrier signals, electromagnetic waves, and signals per se.

The computer-readable media 126 may be used to store and maintain functional components that are executable by the processor 124. In some implementations, these functional components comprise instructions or programs that are executable by the processor 124 and that, when executed, implement operational logic for performing the actions and services attributed above to the vehicle computing device 104. Functional components of the vehicle computing device 104 stored in the computer-readable media 126 may include a vehicle application 130 which may include a series of instructions and/or executable code for causing the processor 124 to perform the functions described herein. For example, the vehicle application 130 may receive the sensor data 116 from the sensors 114, may store the sensor data 116 in the computer-readable media, such as in a buffer or in a more permanent storage location, and may send the sensor data 116 to the service computing device(s) 108. For example, in the case of the suspension vehicle component 112 in this example, the vehicle application 130 may send suspension load data 132 and suspension length data 134 to the service computing device(s) 108.

Furthermore, the vehicle application 130 may receive one or more communications 136 from the service computing devices 108 such as for causing the vehicle application 130 to display or otherwise present a warning or other notification about the vehicle component 112 to an operator of the vehicle 102. As one example, the vehicle 102 may include output components 138 in communication with the vehicle computing device 104 via a CAN bus 140 or other suitable connection. The output components 138 in this example include a display 142 and one or more speakers 144. For instance, the display 142 may be visible to an operator of the vehicle 102, and may display a warning light, a warning message, or other information about the vehicle component 112 to the operator of the vehicle 102. Additionally, or alternatively, the vehicle application may cause one or more speakers 144 to present an audible message to the operator of the vehicle 102 regarding a sensed condition of the vehicle component 112.

In addition, the computer-readable media 126 may also store data, data structures, and the like, that are used by the functional component(s). Data stored by the computer readable media 126 may include the sensor data 116, which, as mentioned above, may be stored temporarily in a buffer or in a more permanent storage location in the computer readable media 126. As one example, the vehicle application 130 may send the sensor data periodically in batches to the service computing devices 108. Alternatively, the sensor data 116 may be continually streamed to the service computing device(s) 108 if the connectivity of the vehicle computing device 104 to the one or more networks 106 permits such streaming In addition, the computer readable media 126 may store a record of the communications 136 received from the service computing device(s) 108. Further, the vehicle computing device 104 may include other logical, programmatic, and/or physical components, of which those described are merely examples that are related to the discussion herein.

The communication interface(s) 128 may include one or more interfaces and hardware components for enabling communication with various other devices, such as over the network(s) 106. For example, communication interface(s) 128 may enable communication through one or more of cellular networks, wireless networks (e.g., Wi-Fi) as well as short-range communications such as BLUETOOTH®, and the like, as additionally enumerated elsewhere herein. Alternatively, in some examples, the communication interface(s) 128 may include the ability to communicate through a wired network (e.g., fiber optic, Ethernet), such as in the case that the communication interfaces are connected to a wired connection that is used to read sensor data 116 directly from the vehicle computing device 104.

The one or more networks 106 may include any appropriate network or combination thereof, including a wide area network, such as the Internet; a local area network, such an intranet; a wireless network, such as a cellular network, a local wireless network, such as Wi-Fi and/or short-range wireless communications, such as BLUETOOTH®; a wired network, including fiber optics and Ethernet; or any other such network, or any combination thereof. Accordingly, the one or more networks 106 may include both wired and/or wireless communication technologies. Components used for such communications can depend at least in part upon the type of network, the environment selected, or both. Protocols for communicating over such networks are well known and will not be discussed herein in detail. Accordingly, vehicle computing device 104 and the service computing device(s) 108 are able to communicate over the one or more networks 106 using wired or wireless connections, and combinations thereof.

In some examples, the vehicle computing device 104 may communicate over the network(s) 106 through a cellular communication interface included in the vehicle 102 or through other type of wireless transmissions. For instance, many vehicles include a cellular transceiver as standard equipment that may be used to transmit the sensor data 116 from the vehicle computing device 104 to the service computing device(s) 108, such as via a cell tower 146. Alternatively, the vehicle computing device 104 may include a dedicated cellular transmitter as at least one of the communication interfaces 128. In some examples, the vehicle computing device 104 may communicate with the service computing device(s) 108 via one or more application programming interfaces (APIs).

In some examples, the service computing device(s) 108 may include one or more servers, personal computers, or other types of computing devices that may be embodied in any number of ways. For instance, in the case of a server, the programs, other functional components, and at least a portion of data storage may be implemented on at least one server, such as in a cluster of servers, a server farm, data center, a cloud-hosted computing service, and so forth, although other computer architectures may additionally or alternatively be used. Thus, the service computing device(s) 108 may be associated with the service provider 110, which may provide a service for monitoring the condition of vehicle components for consumers, fleet managers, manufacturers, or other entities.

The functions performed by the service computing device(s) 108 may be distributed among multiple service computing devices 108 in any desired manner, or may be performed by a single service computing device 108. In the illustrated example, the service computing device(s) 108 include one or more data computing devices 150 and one or more analysis computing devices 152. The computing device(s) 150 and 152 may communicate through a connection 148, which may be a LAN, direct connection, WAN, or the like. Additionally, or alternatively, the computing device(s) 150 and 152 may communicate through the one or more networks 106.

The data computing device(s) 150 may include a monitoring program 154 that may be executed on the data computing device(s) 150. The monitoring program 154 may receive the sensor data, such as the suspension load information 132 and the suspension length information 134, from the vehicle computing device 104, and may store this data in a sensor data database (DB) 156. In some example, such as if the load data 132 is received separately from the length data 134, the monitoring program 154 may chronologically align the data 132, 134 based on timestamp information associated with the received data 132, 134 to match time intervals at which the load data 132 was measured with the same time intervals, respectively, at which the length data 134 was measured.

Furthermore, as discussed additionally below, the monitoring program 154 may divide the received data into a plurality of time windows T, each corresponding to a length of time T over which the sensor data was collected. For each time window T, the monitoring program 154 may send the time window T sensor data 157 to the analysis computing device(s) 152 for analysis to determine any damage that may have occurred to the vehicle component 112 during the respective time window T.

The analysis computing device(s) 152 may include an analysis program 158 and a decomposition program 160. The decomposition program 160 may be part of the analysis program 158, or a separate program from the analysis program 158. As discussed additionally below, the decomposition program 160 may decompose the received sensor data 157 from time window T by dividing the data into smaller portions corresponding to smaller time windows ΔT, and to transform the data into one or more formats accepted by a fatigue simulation program 162 and a damage lookup table 164.

After the data has been decomposed, the decomposed data may be sent to the fatigue simulation program 162 to perform a fatigue analysis using the decomposed sensor data. In addition, the analysis program 158 may access the damage lookup table 164 using the decomposed sensor data to determine an interpolated or extrapolated damage result from the damage lookup table 164. Use of the lookup table 164 enables a real-time determination of the damage to the vehicle component 112 based on the received data 157 of time window T. The damage lookup table 164 may initially be calculated and populated with data in advance using a stand-alone fatigue simulation, or other techniques, and may be augmented using simulation data determined by the fatigue simulation program 162.

The analysis program 158 may thus determine a damage result (e.g., an amount of damage to the component) from the damage lookup table 164 in real time as a damage lookup table (DLT) analysis result 166. For example, for each time window ΔT, a damage result may be determined, and a damage result(1) to damage result(N) corresponding to $\Delta T_1$ to $\Delta T_N$, respectively, may be added together to determine an overall damage result(T) for the time window T as the DLT analysis result 166, where $\Delta T_1+\Delta T_2+ \ldots \Delta T_N=T$.

The DLT analysis result 166 may be sent to the monitoring program 154 on the data computing device(s) 150. The monitoring program 154 may add the DLT analysis result 166 to an accumulated damage for the vehicle component 112 maintained in an accumulated damage database (DB) 168, which stores previously received damage results for the vehicle component. The monitoring program 154 may determine an updated accumulated damage for the vehicle component 112 by adding the damage result in the DLT analysis result 166 to the accumulated damage already maintained in the accumulated damage DB 168 for the vehicle component 112 to determine an updated accumulated damage for the vehicle component 112.

The monitoring program 154 may compare the updated accumulated damage with one or more damage thresholds 170 for determining whether to take any action in response to the DLT analysis result 166. For example, the damage thresholds 170 may include a first threshold, which if exceeded, indicates that a communication 136 is to be sent to the vehicle 102 to cause a warning to be presented to the operator indicating that damage to the vehicle component 112 has been detected, that the vehicle 102 may be unsafe to operate, and/or that the vehicle component 112 otherwise is to be replaced or repaired. Additionally, or alternatively, the communication 136 may be sent to a fleet manager device 172 to notify the fleet manager of the damaged condition of the vehicle component 112 on the vehicle 102. For example, the fleet manager may be in charge of maintenance of a fleet of vehicles participating in the system 100. In some cases, the data computing device(s) 150 may maintain vehicle account information 174 including information for contacting a fleet manager, an operator of the vehicle, or other interested party regarding the condition of the vehicle component 112.

Furthermore, in some examples, a second damage threshold may be lower than the first damage threshold. For instance, if the updated accumulated damage is between the first threshold and the second threshold, this may indicate borderline damage or a lesser amount of damage to the vehicle component 112 than would be the case if the first threshold were exceeded. In this situation, the monitoring program 154 may wait for the results of the fatigue simulation program 162 before sending the communication 136 to the vehicle 102 and/or to the fleet manager device 172. As still another example, if the updated accumulated damage is below the second threshold, the monitoring program 154 may also take no action, and may wait until the results of the fatigue simulation program 162 are received.

The fatigue simulation program 162 may receive the decomposed sensor data decomposed by the decomposition program 160. The decomposed sensor data may include, as inputs to the fatigue simulation program 162, the X and Y load components and the length L information for each time window ΔT, where $\Delta T_1+\Delta T_2+ \ldots \Delta T_N=T$. The fatigue simulation program 162 may use a finite element model 176, the decomposed data, and other information, as discussed below, to determine a damage result for each ΔT. Further, the analysis program 158 may add the damage result and corresponding sensor data for each ΔT to the damage lookup table 164.

As with the results obtained from the damage lookup table 164, the analysis program 158 may add together the individual damage results for all the time windows ΔT to determine a simulation result 178 indicating the total damage for the time window T as determined by the fatigue simulation program 162. For example, the damage results for $\Delta T_1$ to $\Delta T_N$ may be added together to determine the total damage for time T as a simulation result 178, where $\Delta T_1+\Delta T_2+ \ldots \Delta T_N=T$. Thus, the simulation result 178 may include a damage result for the time window T, that is indicative of the fatigue damage experienced by the vehicle component 112, as calculated based on the X and Y loads and the length L measured by the sensors 114 over the time window T. The analysis program 158 may send this simulation result 178 to the monitoring program 154 at the data computing device 150. The analysis program 158 may also store the simulation result 178 at the analysis computing device(s) 152.

The fatigue simulation program 162 performs a simulation analysis of the fatigue damage to the vehicle component 112 using the decomposed sensor data to determine the damage more precisely than may be possible using the same data to look up the damage in the damage lookup table. However, there may typically be a delay associated with performing the fatigue simulation using the fatigue simulation program 162. Following completion of the fatigue simulation, the lookup table 164 may be updated with the damage result determined for each ΔT to provide higher resolution results than may be obtained by relying on interpolation or extrapolation of the damage lookup table 164. Accordingly, while the vehicle 102 is operated, the lookup table 164 may be continually updated using the results of the fatigue simulation program 162.

When the simulation result 178 for the time window T has been determined, the analysis program may send the simulation result 178 to the monitoring program 154. The monitoring program 154 may add the damage of the simulation result 178 to the accumulated damage for the vehicle component 112 maintained in an accumulated damage DB 168 in place of the DLT analysis result 166. In other words, since the simulation result 178 is considered more accurate than the DLT analysis result 166, the monitoring program 154 replaces the DLT analysis result 166 for the time window T with the simulation result 178 for the time window T in the accumulated damage database 168. The monitoring program 154 may determine a new accumulated damage for the vehicle component 112 by adding the damage result in the simulation result 178 to the accumulated damage already maintained in the accumulated damage DB 168 for the vehicle component 112 to determine an updated accumulated damage for the vehicle component 112.

The monitoring program 154 may compare the updated accumulated damage with one or more damage thresholds 170 for determining whether to take any action in response to the simulation result 178. For example, the damage thresholds 170 may include at least the first threshold, which, if exceeded, indicates that a communication 136 is to be sent to the vehicle 102 to cause a warning to be presented to the operator indicating that damage to the vehicle component 112 has been detected, that the vehicle 102 may be unsafe to operate, and/or that the vehicle component 112 otherwise is to be replaced or repaired. Additionally, or alternatively, the communication 136 may be sent to the fleet manager device 172 to notify the fleet manager of the damaged condition of the vehicle component 112 on the vehicle 102. Of course, if the communication(s) 136 was already sent in response to the DLT analysis result 166, then the monitoring program 154 might not resend the communication(s) 136.

Furthermore, in the examples in which there is a second damage threshold that is lower than the first damage threshold, if the updated accumulated damage is between the first damage threshold and the second damage threshold, this may indicate a lesser amount of damage to the vehicle component 112 than would be the case if the first threshold were exceeded. In this situation, since the simulation result 178 is considered more accurate than the DLT analysis result 166, the monitoring program 154 may proceed with sending the communication(s) 136 to the vehicle 102 and/or to the fleet manager device 172. As still another example, if the updated accumulated damage is below the second threshold, the monitoring program 154 may take no action regarding communication(s) 136 to the vehicle 102 and/or to the fleet manager device 172. Alternatively, in some cases, the monitoring program may send a message to the vehicle 102 or to the fleet manager device 172 to indicate the predicted remaining lifespan of the vehicle component.

The data computing device 150 may maintain vehicle account information 174 that may indicate communication information to enable the monitoring program 154 to send the communication(s) 136 to a targeted recipient, such as the vehicle computing device 104 and/or the fleet manager device 172. Thus, the system 100 may employ at least one processor 124 on the vehicle 102 and one or more sensors 114 on the vehicle 102, and at least one service computing device 108 to detect damage to a vehicle component 112, and to provide a warning to a vehicle operator regarding a damaged component in the vehicle 102. The system 100 may begin monitoring the vehicle 102 from the time when the vehicle is new, and may keep track of fatigue damage to one or more vehicle components as the vehicle 102 ages. Accordingly, implementations herein provide an improvement to vehicle operation by detecting a damaged vehicle component and providing a warning or the like to an operator of the vehicle to prevent breakdown or other failure of the vehicle.

Figure 2:
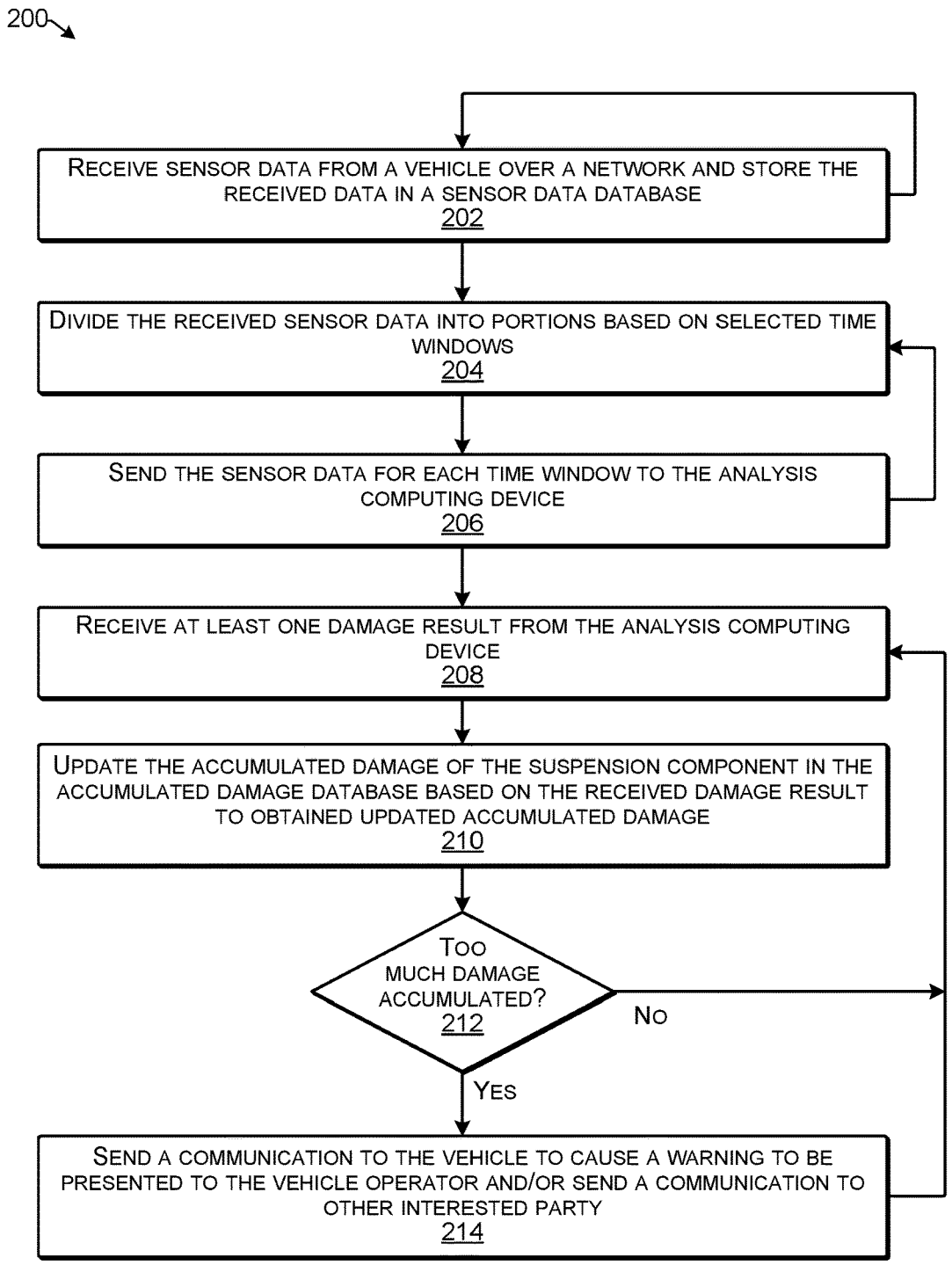
FIG. 2 is a flow diagram illustrating an example process for preventing failure of a vehicle component according to some implementations.
Figure 4:
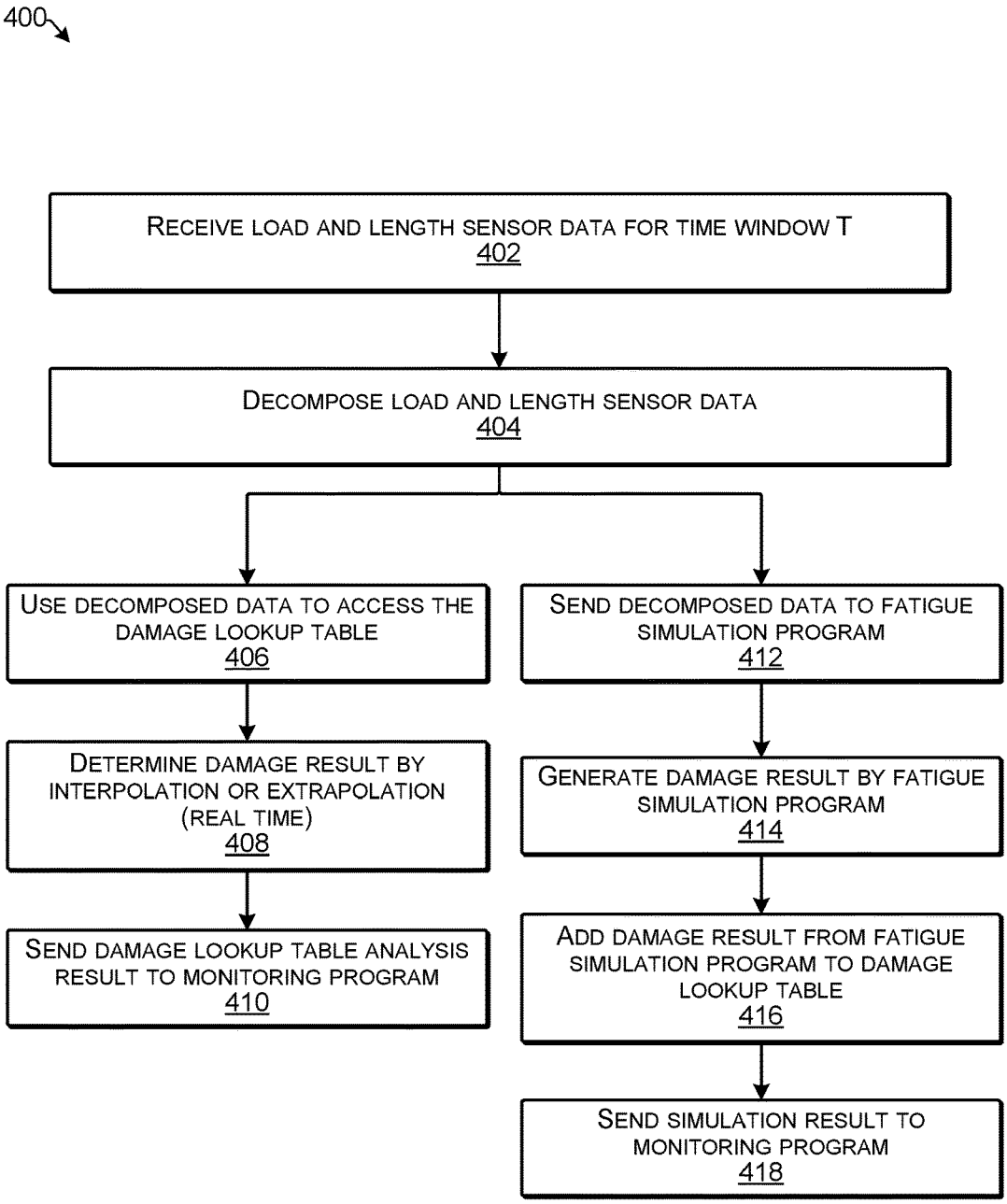
FIG. 4 is a flow diagram illustrating an example process for determining damage information based on sensor data according to some implementations.
Figure 7:
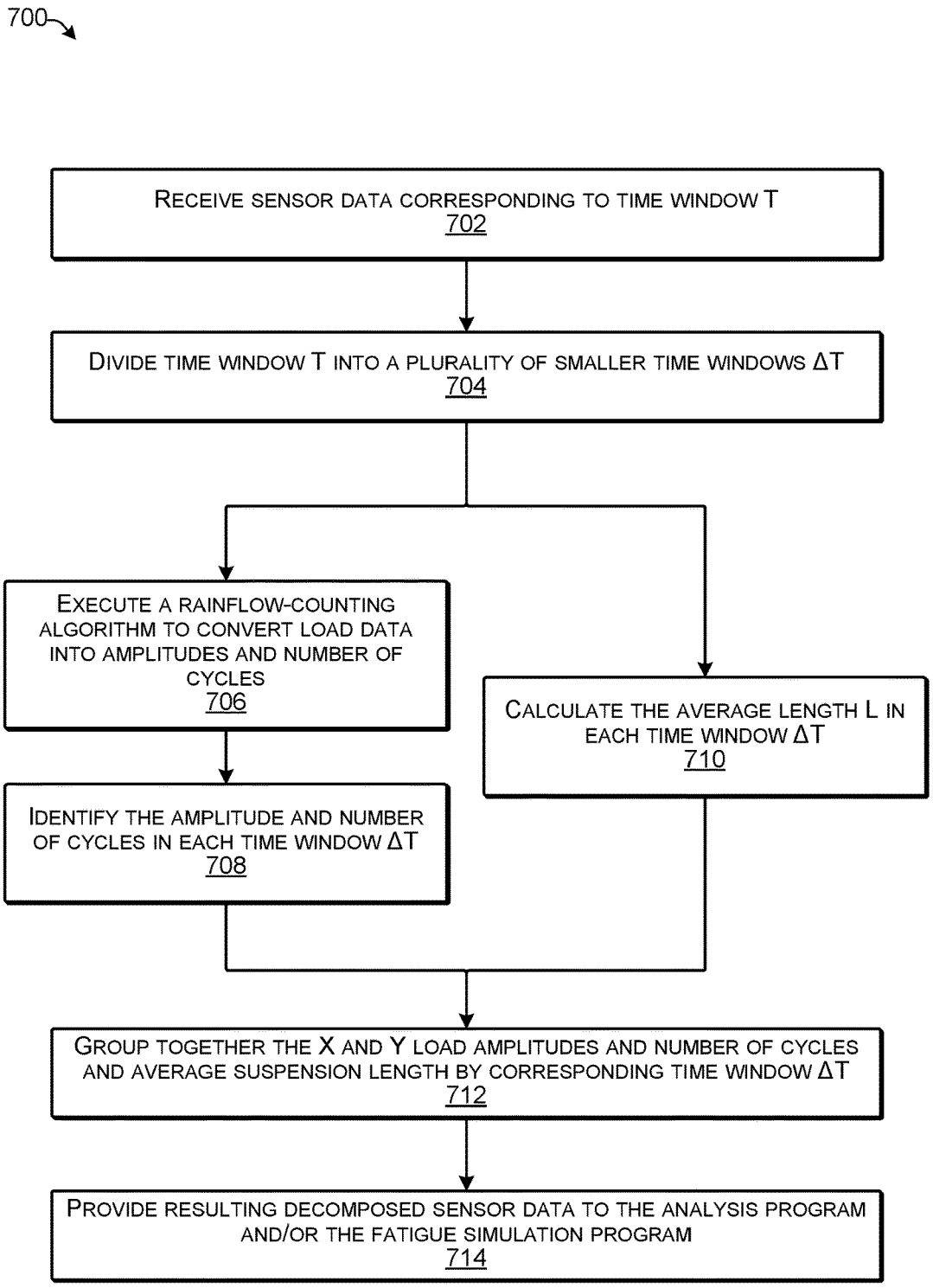
FIG. 7 is a flow diagram illustrating an example process for decomposing sensor data for analysis according to some implementations.

FIGS. 2, 4, and 7 are flow diagrams illustrating example processes according to some implementations. The processes are illustrated as collections of blocks in logical flow diagrams, which represent a sequence of operations, some or all of which can be implemented in hardware, software or a combination thereof. In the context of software, the blocks may represent computer-executable instructions stored on one or more computer-readable media that, when executed by one or more processors, program the processors to perform the recited operations. Generally, computer-executable instructions include routines, programs, objects, components, data structures and the like that perform particular functions or implement particular data types. The order in which the blocks are described should not be construed as a limitation. Any number of the described blocks can be combined in any order and/or in parallel to implement the process, or alternative processes, and not all of the blocks need be executed. For discussion purposes, the processes are described with reference to the environments, systems and devices described in the examples herein, although the processes may be implemented in a wide variety of other environments, systems and devices.

FIG. 2 is a flow diagram illustrating an example process 200 for preventing failure of a vehicle component according to some implementations. For example, the data computing device may perform a plurality of tasks for continually receiving and storing sensor data, sending the sensor data to the analysis computing device for obtaining analysis results, and if the accumulated damage exceeds a threshold, issuing a communication, such as to warn the vehicle operator The monitoring program on the data computing device may configure one or more processors to repeatedly execute these tasks. Accordingly, the process 200 may be executed, at least in part, by the monitoring program on the data computing device.

At 202, the computing device may receive sensor data from a vehicle over a network and store the received data in a sensor data database. Block 202 may be repeated continually while the vehicle is operating. As mentioned above, in some cases the sensor data may be streamed to the data computing device, while in other cases, the sensor data may be sent periodically, e.g., every 10 seconds, every minute, every 10 minutes, and or the like.

At 204, the computing device may divide the received sensor data into portions based on selected time windows T. For example, if sensor data is received for an extended length of time, the data may be divided into time windows T and the data corresponding to each time window T may be determined.

At 206, the computing device may send the sensor data for each time window T to the analysis computing device for obtaining an analysis result. In some cases, the computing device may continually repeat blocks 204 and 206 to keep sending newly received sensor data to the analysis computing device as the sensor data is received.

At 208, the computing device may receive at least one analysis result from the simulation computing device. For example, the computing device may receive an analysis result from the analysis computing device that may be indicative of an amount of fatigue damage that has been incurred by the vehicle component.

At 210, the computing device may update the accumulated damage of the suspension component in the vehicle information database to obtain updated accumulated damage. For instance, when the data computing device receives the analysis results, and the analysis results indicate damage to the vehicle component, the data computing device may update an accumulated damage database for the component to determine updated accumulated damage that include the damage result.

At 212, the computing device may determine whether the damage accumulated for the vehicle component exceeds a threshold. For example, the computing device may compare the accumulate damage with one or more damage thresholds for the damage to the vehicle component. In some cases, the thresholds may be determined from simulated testing of a model of the vehicle component or actual testing of the vehicle component.

At 214, if the damage exceeds the threshold amount, the computing device may send a communication to the vehicle to cause a notification, such as a message, warning, alert, or the like, to be displayed or otherwise presented to the vehicle operator. For example, if the accumulated damage exceeds a threshold, the data computing device may issue a communication to warn the vehicle operator to replace and/or repair the vehicle component. For example, a communication may be sent to the vehicle to cause a warning light to be illuminated, cause a warning message to be displayed on an LCD screen, cause an audible warning to be played, or the like. As another example, the communication may indicate an estimated number of miles remaining before maintenance of the component is recommended. Additionally, or alternatively, if the vehicle is a member of a fleet of vehicles, a communication may be sent to a fleet manager computing device to inform the fleet manager of the damage to the vehicle component. Numerous other variations will be apparent to those of skill in the art having the benefit of the disclosure herein.

Figure 3:
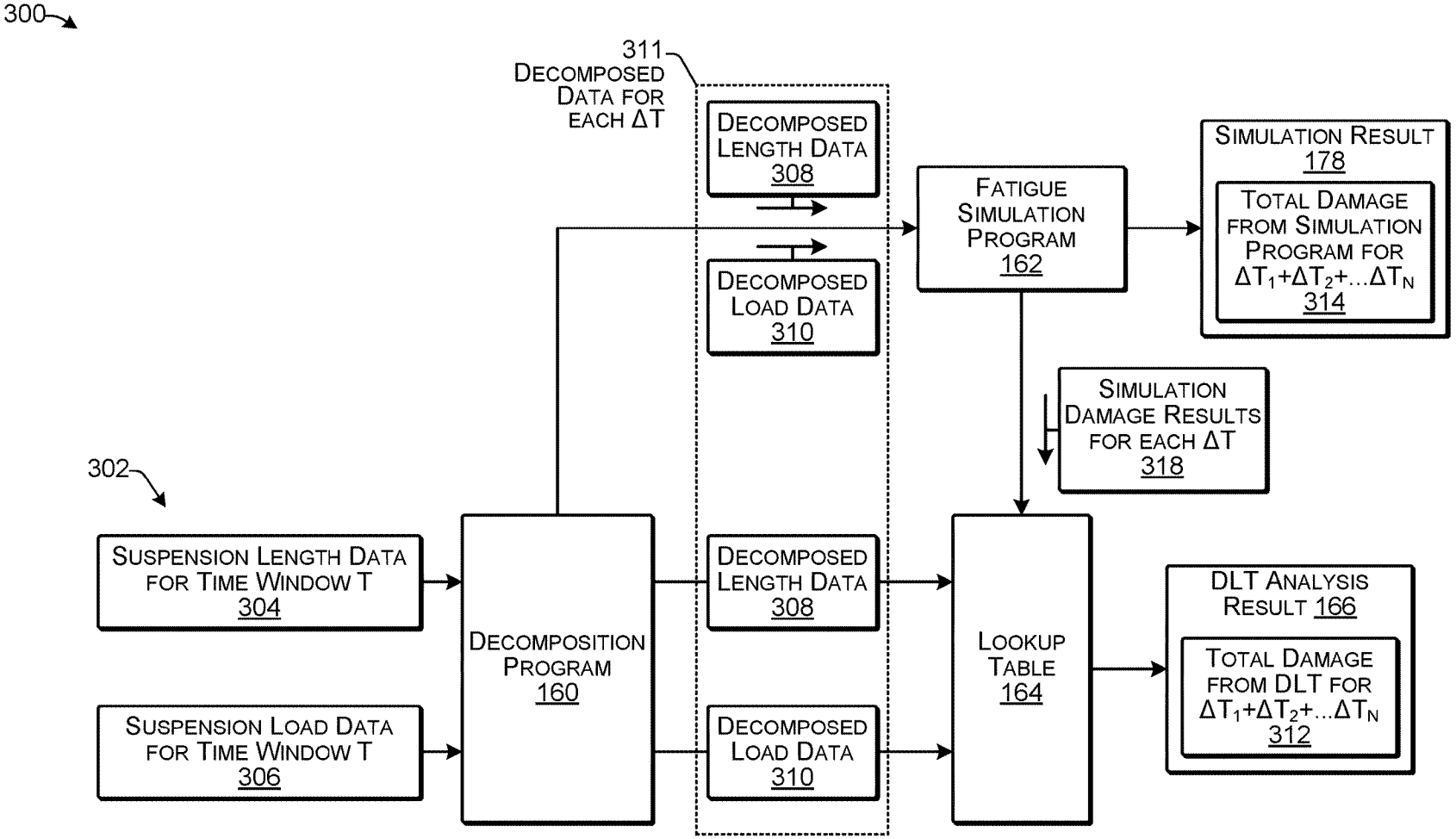
FIG. 3 illustrates an example block diagram of a workflow for processing and analyzing received sensor data according to some implementations.

FIG. 3 illustrates an example block diagram of a workflow 300 for processing and analyzing received sensor data according to some implementations. In some cases, the analysis program on the analysis computing device (not shown in FIG. 3) may manage the workflow 300. For example, the analysis program may receive, from the monitoring program, the sensor data 302 that corresponds to a time window T, as discussed above with respect to FIG. 2. In this example, the sensor data 302 includes suspension length data 304 for the time window T and suspension load data 306 for the time window T.

The sensor data 302 may be provided to or otherwise received by the decomposition program 160, e.g., from the analysis program or the monitoring program. The decomposition program 160 may pre-process the sensor data 302, such as to divide the sensor data into smaller time windows ΔT and to simplify noisy sensor data signals into sinusoidal signals. For example, the simplified sinusoidal signals may be used by the fatigue simulation program for performing fatigue simulation based on the sensor data 302. Furthermore, the simplified sinusoidal signals may be used by the analysis program for accessing the damage lookup table 164 to determine, e.g., in real-time, a damage result from the damage lookup table 164.

In this example, the decomposition program 160 receives the sensor data 302 and decomposes the sensor data 302 into decomposed length data 308 and decomposed load data 310 for each ΔT, as indicated at 311. The decomposed length data 308 and decomposed load data 310 are provided to the fatigue simulation program 162 for executing a fatigue simulation using the decomposed data 308, 310. In addition, the analysis program may use the decomposed length data 308 and decomposed load data 310 to look up a corresponding fatigue damage result in the lookup table 164. Meanwhile, the fatigue simulation program 162 may execute asynchronously to generate simulation damage results 312 for each time window ΔT. The simulation damage results 312 may be added to the lookup table 164 along with the corresponding decomposed length data 308 and decomposed load data 310. Accordingly, the simulation damage results 312 may be added to the lookup table 164 to improve the resolution and real-time result accuracy of the damage information included in the damage lookup table 164.

In this example, the DLT analysis results 166 may be determined by adding together the damage results obtained from the damage lookup table 164 as indicated at 312. The total damage 314 for the time window T may be determined by adding to the damage results obtained for each smaller time window ΔT, e.g., where $\Delta T_1+\Delta T_2+ \ldots \Delta T_N=T$. Thus, the total damage 314 for the time window T may be determined from the damage lookup table 164 in real time, or near real time, and may provide an initial damage assessment of the vehicle component. In some examples, the analysis program may send the DLT analysis result 166 with the total damage 314 determined from the lookup table 164 to the data computing device immediately in response to receipt of the sensor data 302.

Subsequently, following completion of execution of the fatigue simulation program 162, the simulation results 170 may provide total damage 316 determined by totaling together the simulation damage results 312 for each ΔT. Accordingly, the total damage 316 determined by the fatigue simulation program 162 may be more accurate than the total damage 312 determined from the lookup table, but the time for obtaining the total damage 316 may be considerably longer, e.g., minutes or hours, rather than seconds or milliseconds. The analysis program may send the simulation result 178 with the total damage 316 for the time window T determined by the fatigue simulation program 162.

FIG. 4 is a flow diagram illustrating an example process 400 for determining damage information based on sensor data according to some implementations. The process 400 may be executed by the analysis computing device, such as by the analysis program, the decomposition program, and/or the simulation program executing on the analysis computing device or other suitable computing device.

At 402, the computing device may receive, from the data computing device, a portion of load and length sensor data for time window T. For example, the analysis program may receive, for analysis, a portion of the sensor data from the data computing device.

At 404, the computing device may decompose the load data and the length data. For example, the analysis program may provide the sensor data for the given time window T to the decomposition program, which analyzes the sensor data and transforms the sensor data into formats accepted by the fatigue simulation program and the damage lookup table. As discussed additionally below, the sensor data may be in the form of a signal. As part of the decomposition, the decomposition program may smooth the noise from the signal to approximate a sinusoidal form or the like. Following decomposition, the decomposed sensor data may be sent to the fatigue simulation program for performing a fatigue simulation, and may also be applied by the analysis program to the damage lookup table.

At 406, the computing device may apply the decomposed data to the damage lookup table by using the decomposed sensor data to determine damage information based on a closest match to the decomposed sensor data.

At 408, the computing device may determine a damage result by interpolation in the damage lookup table. For example, the analysis program may determine based on the decomposed sensor data an interpolated result from the matching the decomposed sensor data with the sensor data in the damage lookup table.

At 410, the computing device may send the damage information as a DLT analysis result to the monitoring program. For example, the analysis result may be sent back to the data computing device in real time since looking up damage information by interpolation in a lookup table may be performed more quickly than executing a simulation through the fatigue simulation program.

At 412, concurrently, the computing device may initiate execution of a fatigue simulation using the decomposed sensor data to determine a damage information result that may be more precise than the damage information obtained from the damage lookup table. Accordingly, the decomposed sensor data may be sent to a queue for the fatigue simulation program for execution of the fatigue simulation asynchronously with respect to the process of blocks 406-410 in which a determination of damage is made from the damage lookup table. The time for execution of each simulation depends at least in part on the amount of computational resources available for executing the simulation.

At 414, the computing device may generate a damage information result by execution of the fatigue simulation program using the decomposed sensor data as at least a portion of the inputs. Additional details of the fatigue simulation program are discussed additionally below.

At 416, the computing device may add the simulated damage information result to the damage lookup table. For example, the analysis program may receive the damage information from the fatigue simulation program, and may add the damage information and the corresponding decomposed sensor data that was used to generate the damage information to the damage lookup table. The damage information results from the fatigue simulation program may typically provide a high accuracy to the lookup table, and thus, as more fatigue simulation program results are added to the lookup table, the lookup table will continually grow to achieve a higher overall resolution.

At 418, the computing device may send a second analysis result to the monitoring program with the damage information determined by the execution of the fatigue simulation program.

FIG. 5 illustrates an example data structure 500 of received sensor data according to some implementations. In this example, the data structure 500 includes time 502, load 504 sensed in the X direction, load 506 sensed in the Y direction, and sensed rod extension length L 508. In some cases, the timestamp may be determined at the vehicle. Alternatively, if the sampling rate of the sensors at the vehicle is known and consistent, the timestamp may be determined by the data computing device and/or the analysis computing device. In this example, the time 502 corresponds to a sampling rate of 2 millisecond intervals, although longer or shorter sampling rates may be used in other examples. The loads 504, 506, and length 508 may be expressed using any suitable units, which in this example are Newtons and millimeters, respectively. The same data structure may be used for the same type or class of vehicles having the same vehicle component installed. For example, the table may be used for the same year make and model of vehicle having the same component installed. However, for different types of components, the data structure 500 may be different. For example, in the case of a fuel rail, fluctuations in internal pressure may cause fatigue of some parts of the fuel rail. Accordingly, the data structure 500 may include one or more pressure measurements and corresponding time stamps, rather that the X and Y loads and length L. Similarly, for a transmission shaft, torsion strain measurements may be more meaningful than X or Y loads. Other monitored vehicle components may similarly have their own individual sensed parameters that are meaningful for determining fatigue failure.

Figure 6:
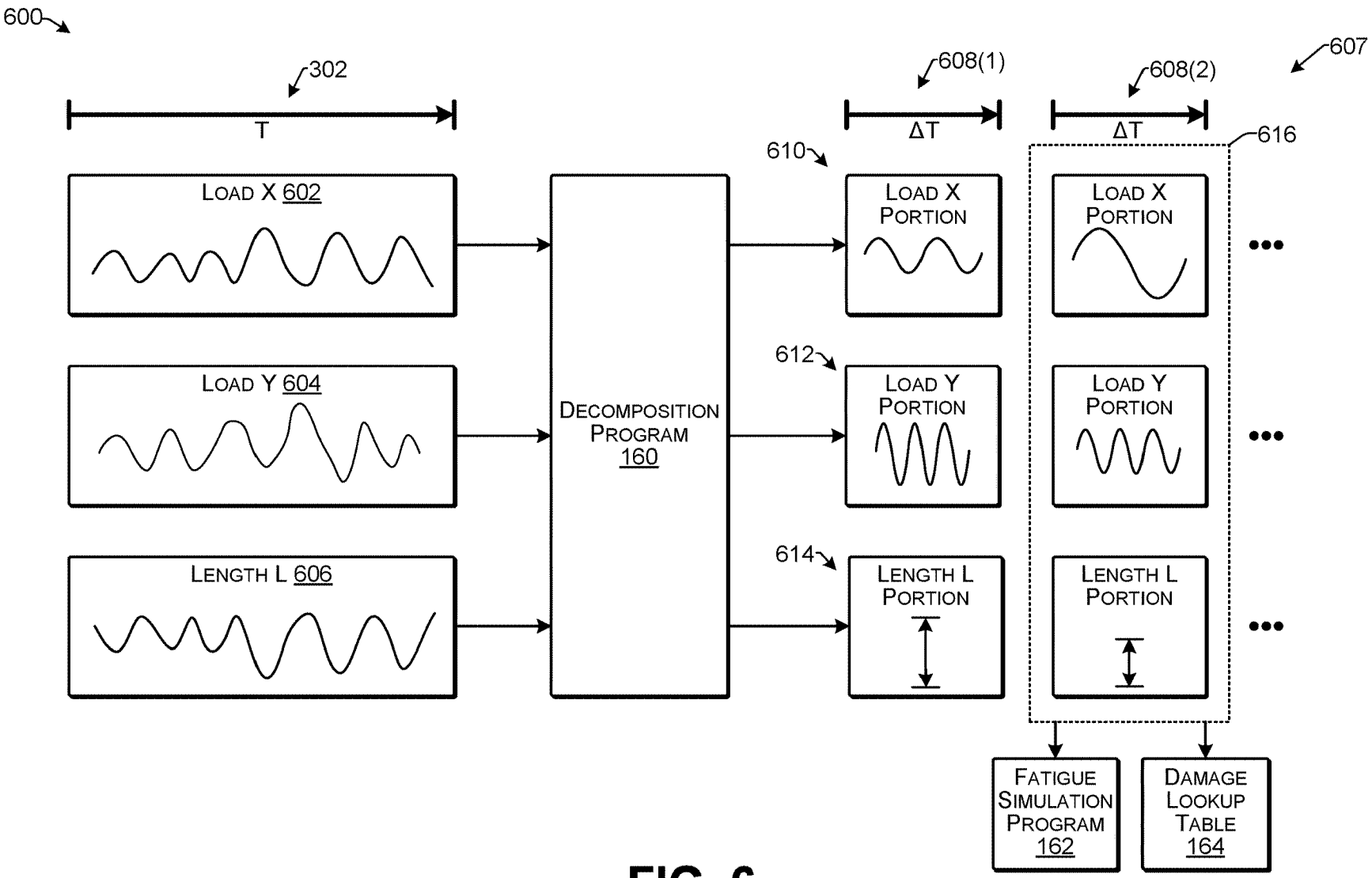
FIG. 6 illustrates an example block diagram of a workflow for sensor data decomposition according to some implementations.

FIG. 6 illustrates an example block diagram of a workflow 600 for sensor data decomposition according to some implementations. In this example, the decomposition program 160 receives the portion of sensor data 302 corresponding to time window T, such as from the monitoring program, as discussed above, e.g., with respect to FIG. 3. Thus, the load X 602, load Y 604 and length L 606 recorded in a time window T are received by the decomposition program 160 for decomposition. For example, the decomposition program 160 may divide the sensor data 302 into a series of smaller time windows ΔT. In each time window ΔT, original noisy load signals in the sensor data 302 are smoothed or otherwise simplified to sinusoidal signals, which can be used by the fatigue simulation program, and which may also be used in the damage lookup table 164. In some examples, the window ΔT may be relatively small in comparison to the time window T, so that the change in suspension length during the time window ΔT may be mathematically insignificant. Accordingly, in this case, the suspension length L may be considered to be equal to its average in each time window ΔT.

In the illustrated example, the sensor data 302 corresponding to time window T is decomposed into the decomposed sensor data 607. The decomposed sensor data 607 includes a plurality of smaller time windows ΔT 608(1), 602(2), . . . . Thus, each smaller time window ΔT includes a decomposed corresponding load X portion 610, load Y portion 612, and length L portion 614. After the sensor data 302 has been decomposed into the decomposed sensor data 607, the three decomposed data portions 610, 612 and 614 for each individual time window ΔT 608 may be used as input signals 616 sent to the fatigue simulation program 162, and also may be used by the analysis program when accessing the lookup table 164 to determine an interpolated or extrapolated damage information.

FIG. 7 is a flow diagram illustrating an example process 700 for decomposing sensor data for analysis according to some implementations. In some examples, the process 700 may be performed by execution of the decomposition program on the analysis computing device or other suitable computing device.

At 702, the computing device may receive sensor data corresponding to time window T. For example, in the case of the suspension vehicle component in the example of FIG. 1, the decomposition program may receive the raw input load X, load Y, and length L in a time window T.

At 704, the computing device may divide time window T into a plurality of smaller time windows ΔT.

At 706, the computing device may run a rainflow-counting algorithm to convert load data into amplitudes and number of cycles. For example, the rainflow-counting algorithm or other suitable algorithm may be used to generate a sinusoidal signal or the like from a noisy signal received as the load data from a sensor. The rainflow-counting algorithm is used in the analysis of fatigue data to reduce a spectrum of varying stress into a set of simple stress reversals. Furthermore, as will be apparent to those of skill in art, there are a number of cycle-counting algorithms that may be used as an alternative to the rainflow-counting algorithm; however, the rainflow-counting method is currently the most widely used.

At 708, the computing device may identify the amplitude and number of cycles in each of the time windows ΔT. For example, the decomposition program may use to rainflow-counting algorithm to convert the load data into amplitudes and number of cycles, which can then be translated into a sinusoidal signal.

At 710, sequentially or concurrently with the execution of blocks 706 and 708, the computing device may determine the average length L in each of the time windows ΔT. As mentioned above, the length L is assumed to be constant in the time windows ΔT, and the value of the length L is the average value over the respective time window ΔT.

At 712, the computing device may group together the X and Y load amplitudes and number of cycles, and the average suspension length L according to the corresponding time windows ΔT.

At 714, the computing device may provide the resulting decomposed sensor data to the analysis program and/or to the fatigue simulation program. Accordingly, after the sensor data is decomposed into the time windows ΔT, the decomposed load X, load Y, and length L are sent to the analysis program for use in accessing the lookup table, and are further sent to the fatigue simulation program for execution of a fatigue simulation using the decomposed sensor data. The damage results determined for all of the time windows ΔT are subsequently added together to determine the final damage result for the original time window T.

The example processes described herein are only examples of processes provided for discussion purposes. Numerous other variations will be apparent to those of skill in the art in light of the disclosure herein. Additionally, while the disclosure herein sets forth several examples of suitable frameworks, architectures and environments for executing the processes, implementations herein are not limited to the particular examples shown and discussed. Furthermore, this disclosure provides various example implementations, as described and as illustrated in the drawings. However, this disclosure is not limited to the implementations described and illustrated herein, but can extend to other implementations, as would be known or as would become known to those skilled in the art.

FIG. 8 illustrates an example data structure 800 of the damage lookup table 164 according to some implementations. In this example, the lookup table includes a load X amplitude 802, a load Y amplitude 804, a length L 806, and a damage 808. Thus, in each row of the damage lookup table 164, the inputs are load X, load Y and length L, assuming each load is applied as sinusoidal signal for a total of one period. The output is the damage due to such load and length. For example, the damage may have been determined empirically or by finite element analysis and may be a unitless value that has a meaning relative to the other values in the damage lookup table. Furthermore, one or more thresholds for damage (not shown in FIG. 8) may be determined empirically or through finite element analysis. For example, the one or more thresholds may be used by the monitoring program for determining when to send one or more communications based on a comparison of a current level of damage with the one or more thresholds.

Figure 9:
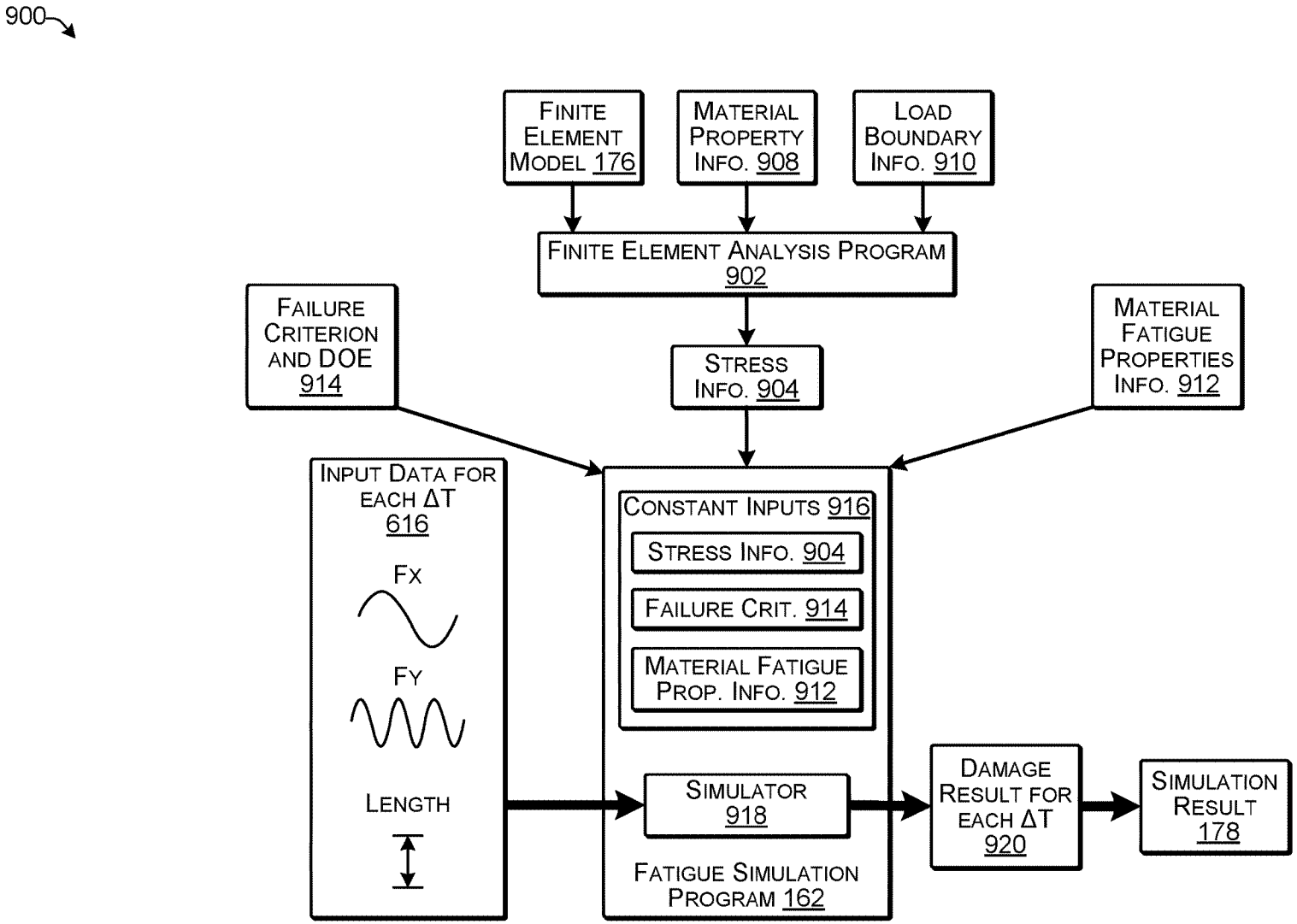
FIG. 9 illustrates an example block diagram of a workflow for fatigue simulation and analysis according to some implementations.

FIG. 9 illustrates an example block diagram of a workflow 900 for fatigue simulation according to some implementations. In this example, the workflow 900 may include two simulation processes. For instance, a finite element analysis program 902 may be executed first, and the resulting stress information 904 may be subsequently used by the fatigue simulation program 162 during fatigue damage determination. Furthermore, the same finite element model 176 such as a 3D CAD (computer aided design) model, which is constructed for the finite element analysis program 902, may also be used for determining the fatigue damage. Typically, finite element analysis program 902 may output stress information, i.e., the stress data 904, based on simulated forces applied to the finite element model 176. The finite element analysis program 902 may also receive as inputs material property information 908, which may include stress vs. strain properties of the material(s) from which the vehicle component 112 is constructed, such as metal, polymers, ceramics, and so forth. Furthermore, the finite element analysis program 902 may receive load boundary information that indicates the range of forces that may be applied to parts of the vehicle component.

For the decomposed sensor input data 616, the nature of the input data 616 depends on the type of component being monitored for damage. For example, different vehicle components may suffer from different fatigue forces. A fuel rail may undergo fatigue from high internal pressure changes as the internal fuel pressure fluctuates, and therefore would not have a length data component. The fuel pressure may be monitored at one or more locations on the fuel rail, or elsewhere, and the sensed pressure data may be sent to the service computing device(s) 108 to predict damage to the fuel rail or one or more parts thereof. As another example, for a transmission shaft, the length change also typically would not be measured, but certain other forces may be measured, such as rotations per minute or side forces. Accordingly, the finite element analysis and fatigue analysis herein may encompass the ways that the particular vehicle component being monitored may be damaged.

In the example of FIG. 9, the finite element model 176, material property information 908, such as the stress vs. strain properties of the materials used to make the vehicle component, and the load boundary information 910, which includes the expected range of loads to be applied to various parts of the vehicle component in real-world operation, are provided to the finite element analysis program 902. With the finite element model 176, material property information 908, and load boundary information 910, the finite element analysis program 902 is executed. Finite element analysis may typically include dividing the vehicle component into a large number of small cells and determining the stress on each cell. Subsequently, the fatigue simulation program examines the vehicle component and indicates which parts of the vehicle component may be experiencing fatigue damage, and the amount of the damage. The output of the finite-element analysis program 902 may include the stress information 904, which, in some cases, may be treated as a formula that takes load as input and provides damage as output. Examples of finite element analysis software that may be used in some examples herein include ANSYS® available from Ansys Inc. of Canonsburg, Pa.; COMSOL MULTIPHYSICS® available from COMSOL Inc. of Stockholm, Sweden; and MSC NASTRAN™ available from MSC Software of Newport Beach, Calif.

Additional inputs for the fatigue simulation program 162 may include material fatigue properties 912 of the material(s) used to construct the vehicle component. The material fatigue properties may indicate how quickly the material accumulates fatigue damage.

Another input may include failure criterion and DOE 914. The design of experiments (DOE) is a design of a task that aims to describe or explain the variation of information under conditions that are hypothesized to reflect the variation. The change in a predictor is generally hypothesized to result in a change in a second variable, hence referred to as the outcome (dependent) variable. Experimental design involves not only the selection of suitable predictors and outcomes, but planning the delivery of the experiment under statistically optimal conditions given the constraints of available resources. Accordingly, the failure criterion and DOE may establish a guideline regarding when to pronounce a failure based on the accumulated damage. Further, the one or more damage thresholds 170 discussed above, e.g., with respect to FIG. 1, may be determined at least partially based on the failure criterion and DOE 914.

Typically, the stress information 904 might only be determined one time, and may be considered constant. Accordingly, the fatigue simulation program 162 may employ constant inputs 916 that include the stress information 904, the failure criterion and DOE 914, and the material fatigue properties 912. In addition, the fatigue simulation program 162 may include a fatigue simulator 918, which may be obtained from a number of different vendors for performing fatigue simulation based on the inputs. In some examples, the simulator 918 may be trained based on empirical information, such as may be obtained from bench testing of the actual components to determine the actual number of cycles and/or to quantify the actual loads for causing failure of the component. Examples of fatigue simulation software that may be used as the simulator 918 herein include the finite element analysis software packages listed above, as well as MSC FATIGUE™ available from MSC Software of Newport Beach, Calif., and numerous other commercially available software packages.

In the illustrated example, the fatigue simulation program 162 may output a damage result 920 for each input of data 616 for each time window $\Delta T$. An example data structure of the output is illustrated in FIG. 10. Further, as mentioned above, the damage results 920 for multiple time windows $\Delta T$ may be added together to determine a total damage experienced by the vehicle component over the time window T, where $\Delta T_1+\Delta T_2+ \ldots \Delta T_N=T$. Thus, the total damage result may be sent to the monitoring program as the simulation result 178 for the time window T.

FIG. 10 illustrates an example data structure 1000 of an output from the fatigue simulation program according to some implementations. In this example, the output data structure 1000 may have a format that matches or is otherwise compatible with the damage lookup table 164 (not shown in FIG. 10) discussed above, e.g., with respect to FIG. 8. Therefore, the output data may be inserted directly into the damage lookup table to enhance interpolation accuracy within the damage lookup table.

Figure 11:
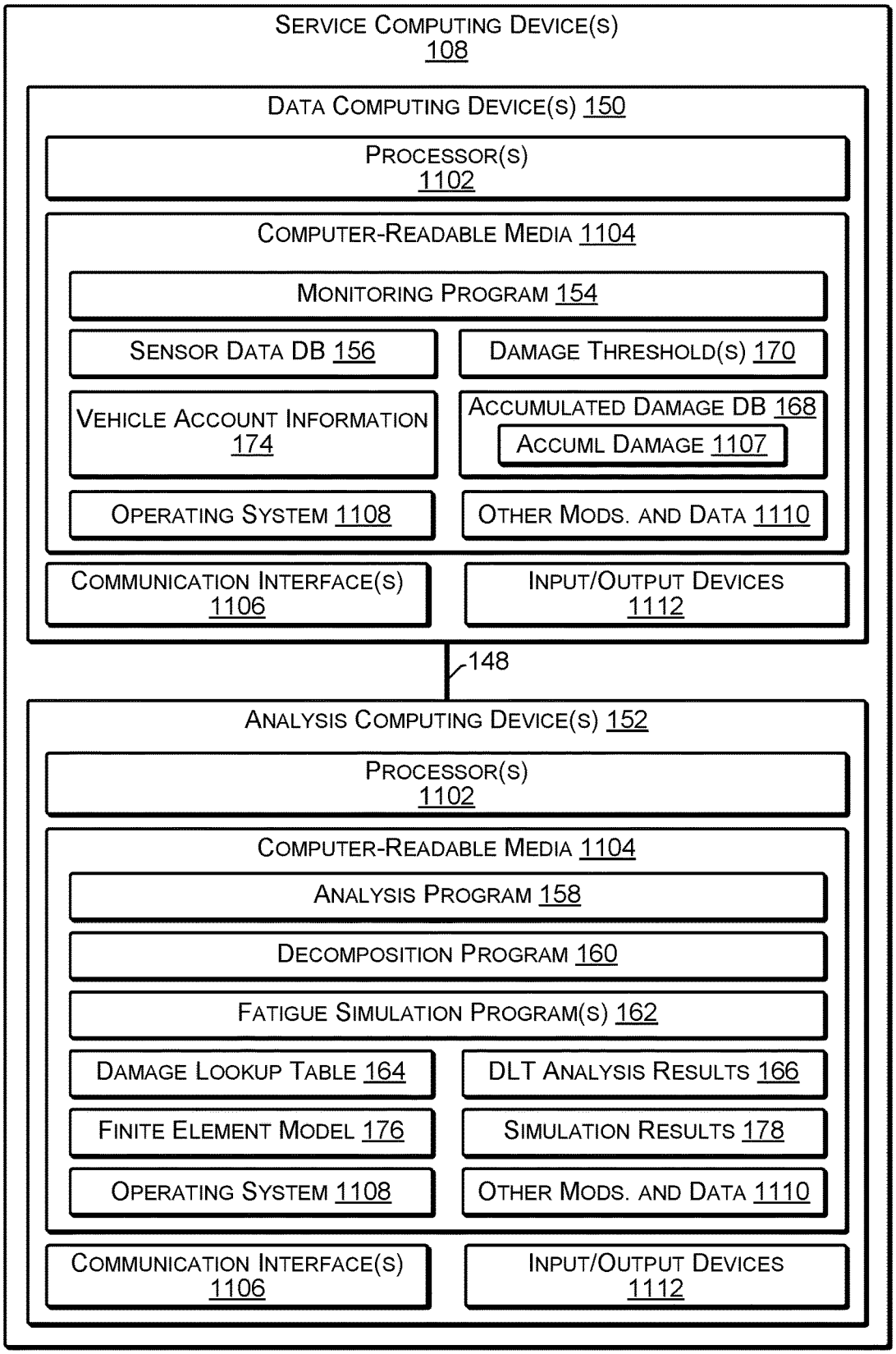
FIG. 11 illustrates select components of example service computing devices according to some implementations.

FIG. 11 illustrates select components of the service computing device(s) 108, which may be used to implement some functionality of the services described herein. As mentioned above, the service computing device(s) 108 may include one or more servers, personal computers, or other types of computing devices that may be embodied in any number of ways. For instance, in the case of a server, the programs, applications, other functional components, and data may be implemented on a single server, a cluster of servers, a server farm, a data center, a cloud-hosted computing service, and so forth, although other computer architectures may additionally or alternatively be used.

Further, while the figures illustrate the components and data of the service computing devices 108 as being present in a single location, these components and data may alternatively be distributed across different computing devices and different locations in any manner Consequently, the functions may be implemented by one or more service computing devices 108, with the various functionality described above distributed in various ways across the different computing devices. Multiple service computing devices 102 may be located together or separately, and organized, for example, as virtual servers, server banks, and/or server farms. The described functionality may be provided by the servers of a single entity or enterprise, or may be provided by the servers and/or services of multiple different entities or enterprises. Accordingly, implementations herein are not limited to the particular example illustrated.

In the illustrated example, each service computing devices 108 include the one or more data computing devices 150 and the one or more analysis computing devices 152. Each of these computing devices may include one or more processors 1102, one or more computer-readable media 1104, and one or more communication interfaces 1106. Each processor 1102 may be a single processing unit or a number of processing units, and may include single or multiple computing units, or multiple processing cores. The processor(s) 1102 may be implemented as one or more microprocessors, microcomputers, microcontrollers, digital signal processors, central processing units, state machines, logic circuitries, and/or any devices that manipulate signals based on operational instructions. For instance, the processor(s) 1102 may be one or more hardware processors and/or logic circuits of any suitable type specifically programmed or otherwise configured to execute the algorithms and processes described herein. The processor(s) 1102 may be configured to fetch and execute computer-readable instructions stored in the computer-readable media 1104, which may program the processor(s) 1102 to perform the functions described herein.

The computer-readable media 1104 may include volatile and nonvolatile memory and/or removable and non-removable media implemented in any type of technology for storage of information, such as computer-readable instructions, data structures, program modules, or other data. Such computer-readable media 1104 may include, but is not limited to, RAM, ROM, EEPROM, flash memory or other memory technology, optical storage, solid state storage, magnetic tape, magnetic disk storage, RAID storage systems, storage arrays, network attached storage, storage area networks, cloud storage, or any other medium that can be used to store the desired information and that can be accessed by a computing device. Depending on the configuration of the service computing device 108, the computer-readable media 1104 may be a type of computer-readable storage media and/or may be a tangible non-transitory media to the extent that, when mentioned, non-transitory computer-readable media exclude media such as energy, carrier signals, electromagnetic waves, and signals per se.

The computer-readable media 1104 may be used to store any number of functional components that are executable by the processors 1102. In many implementations, these functional components comprise instructions or programs that are executable by the processors 1102 and that, when executed, specifically configure the one or more processors 1102 to perform the actions attributed above to the service computing device 108. Functional components stored in the computer-readable media 1104 of the data computing device(s) 150 may include the monitoring program 154, while functional components stored on the computer-readable media 1104 of the analysis computing device(s) 152 may include the analysis program 158, the decomposition program 160, and the fatigue simulation program 162. Additional functional components stored in the computer-readable media 1104 may include an operating system 1108 for controlling and managing various functions of the service computing device(s) 108.

In addition, the computer-readable media 1104 may store data and data structures used for performing the operations described herein. Thus, the computer-readable media 1104 on the data computing device(s) 150 may store the sensor data DB 156, the damage threshold(s) 170, the vehicle account information 174, and the accumulated damage DB 168, including an accumulated damage 1107. Further, while the sensor data DB 156 and the accumulated damage DB 168 are referred to as databases herein for convenience, these databases may be constructed as any desired type of data structure and are not limited to traditional database structures. In addition, the computer-readable media 1104 on the analysis computing device(s) 152 may store the damage lookup table 164, the finite element model 176, the DLT analysis results 166, and the simulation results 178. The service computing device(s) 108 may also include or maintain other functional components and data not specifically shown in FIG. 11, such as other modules and data 1110, which may include programs, drivers, etc., and the data used or generated by the functional components. Further, the service computing device 108 may include many other logical, programmatic, and physical components, of which those described above are merely examples that are related to the discussion herein.

The communication interface(s) 1106 may include one or more interfaces and hardware components for enabling communication with various other devices, such as over the network(s) 106. For example, communication interface(s) 1106 may enable communication through one or more of the Internet, cable networks, cellular networks, wireless networks (e.g., Wi-Fi) and wired networks (e.g., fiber optic and Ethernet), as well as short-range communications, such as BLUETOOTH®, and the like, as additionally enumerated elsewhere herein.

The service computing device(s) 108 may further be equipped with various input/output (I/O) devices 1112. Such I/O devices 1112 may include a display, various user interface controls (e.g., buttons, joystick, keyboard, mouse, touch screen, etc.), audio speakers, connection ports and so forth.

Various instructions, methods, and techniques described herein may be considered in the general context of computer-executable instructions, such as program modules stored on computer-readable media, and executed by the processor(s) herein. Generally, program modules include routines, programs, objects, components, data structures, etc., for performing particular tasks or implementing particular abstract data types. These program modules, and the like, may be executed as native code or may be downloaded and executed, such as in a virtual machine or other just-in-time compilation execution environment. Typically, the functionality of the program modules may be combined or distributed as desired in various implementations. An implementation of these modules and techniques may be stored on computer storage media or transmitted across some form of communication media.

Although the subject matter has been described in language specific to structural features and/or methodological acts, it is to be understood that the subject matter defined in the appended claims is not necessarily limited to the specific features or acts described. Rather, the specific features and acts are disclosed as example forms of implementing the claims.

What is claimed:

1. A system comprising:

one or more processors; and one or more non-transitory computer-readable media maintaining executable instructions, which, when executed by the one or more processors, cause the one or more processors to perform operations comprising:

receiving, from a vehicle computing device, sensor data for at least one sensed parameter of a vehicle component sensed over a first time window;

determining a damage result based on the sensor data by:

accessing a lookup table to determine, for the sensor data, a lookup table damage result indicative of fatigue damage to the vehicle component; and executing a fatigue simulation using the sensor data to determine a simulator damage result indicative of fatigue damage to the vehicle component;

adding the lookup table damage result to accumulated damage previously determined for the vehicle component to obtain a first updated accumulated damage;

when the first updated accumulated damage result is greater than a first threshold, sending a communication to the vehicle to cause the vehicle to present an indication of damage incurred by the vehicle component;

when the first updated accumulated damage is less than the first threshold and greater than a second threshold, waiting to receive the simulator damage result to determine whether to send the communication;

following receipt of the simulator damage result, adding the simulator damage result to the accumulated damage for the vehicle component in place of the lookup table damage result to obtain a second updated accumulated damage; and based at least on the second updated accumulated damage being greater than the second threshold, sending, the communication to the vehicle to cause the vehicle to present the indication of the damage incurred by the vehicle component.

2. The system as recited in claim 1, wherein the received sensor data corresponds to a first time window, the operations further comprising:

dividing the first time window into a plurality of smaller second time windows;

determining, from the received sensor data, respective sensor data portions corresponding to respective ones of the second time windows; and determining respective sinusoidal approximations of the respective sensor data portions corresponding to the respective second time windows.

3. The system as recited in claim 2, the operations further comprising:

determining the lookup table damage result by accessing the lookup table to determine, for the respective sensor data portions, respective lookup table damage results indicative of fatigue damage to the vehicle component for the respective ones of the second time windows; and adding together the respective lookup table damage results for the plurality of second time widows to determine the lookup table damage result.

4. The system as recited in claim 2, the operations further comprising:

determining the simulator damage result by executing a fatigue simulation using the respective sensor data portions to determine respective simulation damage results indicative of fatigue damage to the vehicle component for the respective ones of the second time windows; and adding together the respective simulation damage results for the plurality of second time windows to determine the simulator damage result.

5. The system as recited in claim 4, the operations further comprising adding, to the lookup table, the respective simulation damage results for the respective ones of the second time windows and data from corresponding sensor data portions for the respective ones of the second time windows to improve accuracy of the lookup table.

6. The system as recited in claim 1, wherein the communication causes the vehicle computing device to present, as the indication of the damage incurred by the vehicle component, at least one of a visual or audible warning indicating damage to the vehicle component.

7. The system as recited in claim 1, the operations further comprising sending, to a computing device associated with an account associated with the vehicle, the indication of the damage incurred by the vehicle component.

8. A method comprising:

receiving, by one or more processors, over a network from a vehicle computing device onboard a vehicle, sensor data for at least one sensed parameter of a vehicle component;

determining, by the one or more processors, based on the sensor data, a damage result indicative of fatigue damage to the vehicle component by:

accessing a lookup table to determine, for the sensor data, a lookup table damage result indicative of fatigue damage to the vehicle component; and executing a fatigue simulation using the sensor data to determine a simulator damage result indicative of fatigue damage to the vehicle component;

when the lookup table damage result indicates total accumulated damage greater than a first threshold, sending, by the one or more processors, a communication to the vehicle computing device onboard the vehicle to cause the vehicle to present an indication of damage incurred by the vehicle component;

when the lookup table damage result indicates the total accumulated damage is less than the first threshold and greater than a second threshold, waiting, by the one or more processors, to receive the simulator damage result to determine whether to send the communication; and following receipt of the simulator damage result and based at least on the simulator damage result indicating the total accumulated damage is greater than the second threshold, sending, by the one or more processors, the communication to the vehicle computing device onboard the vehicle to cause the vehicle to present the indication of the damage incurred by the vehicle component.

9. The method as recited in claim 8, further comprising sending, to a computing device associated with an account associated with the vehicle, the indication of the damage incurred by the vehicle component.

10. The method as recited in claim 8, further comprising:

adding the lookup table damage result to an accumulated damage previously determined for the vehicle component to determine first updated accumulated damage as the total accumulated damage;

comparing the first updated accumulated damage with the first threshold to determine that the updated accumulated damage exceeds the first threshold; and sending the communication at least partially based on the first updated accumulated damage exceeding the first threshold.

11. The method as recited in claim 8, wherein executing the fatigue simulation using the sensor data includes receiving input from a finite element model of the vehicle component.

12. The method as recited in claim 8, wherein the received sensor data corresponds to a first time window, the method further comprising:

dividing the first time window into a plurality of smaller second time windows;

determining, from the received sensor data, respective sensor data portions corresponding to respective ones of the second time windows; and determining respective sinusoidal approximations of the respective sensor data portions corresponding to the respective second time windows.

13. The method as recited in claim 12, further comprising:

executing the fatigue simulation using the respective sinusoidal approximations of each of the respective sensor data portions to determine respective simulation damage results for the respective second time windows; and adding together the respective simulation damage results for the plurality of second time windows to determine the simulation damage result for the first time window.

14. The method as recited in claim 13, wherein the lookup table includes a plurality of damage results and corresponding sensor data, the method further comprising adding the respective simulation damage results for the respective second time windows and data from corresponding sensor data portions to the lookup table to improve accuracy of the lookup table.

15. One or more non-transitory computer-readable media storing executable instructions, which, when executed by one or more processors, configure the one or more processors to:

receive, from a vehicle computing device onboard a vehicle, sensor data of at least one sensed condition of a vehicle component over a first time window;

determine a damage result based on the sensor data by:

accessing a lookup table to determine, for the sensor data, a lookup table damage result indicative of fatigue damage to the vehicle component; and executing a fatigue simulation using the sensor data to determine a simulator damage result indicative of fatigue damage to the vehicle component;

when the lookup table damage result indicates total accumulated damage greater than a first threshold, send, a communication to the vehicle computing device onboard the vehicle to cause the vehicle to present an indication of damage incurred by the vehicle component;

when the lookup table damage result indicates the total accumulated damage is less than the first threshold and greater than a second threshold, wait to receive the simulator damage result to determine whether to send the communication; and following receipt of the simulator damage result and based at least on the simulator damage result indicating the total accumulated damage is greater than the second threshold, send the communication to the vehicle computing device onboard the vehicle to cause the vehicle to present the indication of the damage incurred by the vehicle component.

16. The one or more non-transitory computer-readable media as recited in claim 15, wherein, prior to sending the communication, the one or more processors are further configured to:

add the lookup table damage result to an accumulated damage previously determined for the vehicle component to determine first updated accumulated damage;

compare the first updated accumulated damage with the first threshold to determine that the updated accumulated damage exceeds the first threshold; and send the communication at least partially based on the first updated accumulated damage exceeding the first threshold.

17. The one or more non-transitory computer-readable media as recited in claim 15, wherein the one or more processors are further configured to send, to a computing device associated with an account associated with the vehicle, the indication of the damage incurred by the vehicle component.

18. The one or more non-transitory computer-readable media as recited in claim 15, wherein the received sensor data corresponds to a first time window, and the one or more processors are further configured to:

divide the first time window into a plurality of smaller second time windows;

determine, from the received sensor data, respective sensor data portions corresponding to respective ones of the second time windows; and determine respective sinusoidal approximations of the respective sensor data portions corresponding to the respective second time windows.

19. The one or more non-transitory computer-readable media as recited in claim 18, wherein the one or more processors are further configured to:

execute the fatigue simulation using the respective sinusoidal approximations of each of the respective sensor data portions for the respective second time windows to determine respective simulation damage results; and add together the respective simulation damage results for the plurality of second time windows to determine a simulation damage result for the first time window.

20. The one or more non-transitory computer-readable media as recited in claim 19, wherein the one or more processors are further configured to:

determine the respective sinusoidal approximations of the respective sensor data portions using a counting algorithm to remove noise from a sensor signal included in the received sensor data; and add, to the lookup table, information corresponding to the respective sinusoidal approximations of the respective sensor data portions for the respective second time windows to improve accuracy of the lookup table.

* * * * *